United States Patent [19]

Swanson

[11] Patent Number: 4,621,943

[45] Date of Patent: Nov. 11, 1986

[54] CONTINUOUS PRESTRESSED CONCRETE AND METHOD

[75] Inventor: David T. Swanson, Saratoga, Calif.

[73] Assignee: VSL Corporation, Los Gatos, Calif.

[21] Appl. No.: 658,542

[22] Filed: Oct. 9, 1984

[51] Int. Cl.[4] ..... E01C 5/10; E01C 11/20

[52] U.S. Cl. ..... 404/70; 404/72; 52/227; 264/228; 264/229

[58] Field of Search ..... 404/47, 70, 134–136, 404/72; 52/223 R, 227, 228; 264/35, 228, 229

[56] References Cited

U.S. PATENT DOCUMENTS

| | | | |
|---|---|---|---|
| 2,590,685 | 3/1952 | Coff | 404/70 |
| 2,655,846 | 10/1953 | Freyssinet | 404/70 |
| 2,833,186 | 5/1958 | Dobell | 404/70 X |
| 2,950,517 | 8/1960 | Brickman | 404/70 X |
| 3,022,713 | 2/1962 | Friberg | 404/70 X |
| 3,072,994 | 1/1963 | Brickman | 404/70 X |
| 3,089,215 | 5/1963 | Stubbs | 404/70 X |
| 3,182,109 | 5/1965 | Greulich | 404/70 X |
| 3,237,537 | 3/1966 | Hutchings | 404/70 |
| 3,516,211 | 6/1970 | Rieve | 52/230 |
| 3,527,553 | 9/1970 | Adler | 404/83 X |
| 4,191,490 | 3/1980 | Barnett | 404/70 |
| 4,245,923 | 1/1981 | Rieve | 404/70 |

*Primary Examiner*—Stephen J. Novosad
*Assistant Examiner*—John F. Letchford
*Attorney, Agent, or Firm*—John F. Booth; Gerald G. Crutsinger; Norman L. Gundel

[57] ABSTRACT

Disclosed is a method and apparatus for forming continuous slabs having parallel longitudinally extending post-tensioned tendons therein.

14 Claims, 10 Drawing Figures

CONTINUOUS PRESTRESSED CONCRETE AND METHOD

TECHNICAL FIELD

The present invention relates to post-tension elongated concrete structures such as roads, highways and the like and improved methods for installing these structures.

BACKGROUND OF THE INVENTION

Due to its strength, permanency, and relative low cost, concrete is the most important building material employed in modern construction. It is widely used for foundations of all types including buildings, bridges, dams, retaining walls, highways and the like. However, the adequacy of concrete for functioning under a particular set of conditions depends upon many factors such as the selection and mixing of materials, placement of the concrete and the structural design. One factor bearing upon the use of concrete is the fact that it is strong in compression, but relatively weak in tension. Therefore, structures in which concrete is likely to be in tension must be reinforced.

One method that is widely used to overcome the disadvantages of concrete's low tensile strength is the prestressing of concrete with reinforcement. This is accomplished by use of high strength steel wires, cables, or rods embedded within the concrete. In prestressing of concrete, the concrete member is precompressed and thus when the structure receives a load, the compression is relieved on that portion which would normally be in tension. Thus, for example, a beam is prestressed so that when the concrete is under load, the side normally in tension has no tensile forces acting upon it.

There are generally two methods of prestressing, namely—pretensioning and post-tensioning. Pretensioning consists of pouring concrete around steel members kept under tension until the concrete has gained sufficient strength. Tension is removed and compression forces are thereby imparted to the concrete through bonds between the steel members and the concrete. Post-tensioning consists of jacking bondfree cables against the ends of an already hardened concrete section and then anchoring the ends of the cable to maintain the cable in tension. In elongated concrete structures such as roads, highways, landing strips and the like, post-tensioning is used because it requires less concrete, and can be less expensive.

The configuration of an elongated slab such as a highway, however, presents special problems in the installation of the prestressing material. It has been proposed to prestress such elongated slabs from the sides of the slab. Examples of prestressing concrete structures from the sides are described in U.S. Pat. Nos. 2,590,685; 2,655,846; 2,833,186; 2,950,517; 3,072,994; 3,182,109; and 4,191,490. In some of these structures, the prestressing elements extend transverse to the length of the slab, and in others the prestressing elements extend diagonally across the slab. In each instance the prestressing elements are tensioned from the side of the slab and thus access must be provided for stressing equipment such as jacks, rachets or the like for use in tensioning the post-tensioning elements in the slab. Prestressing the slabs from the edges presents disadvantages in that the short transverse or diagonal elements require more labor to install. The necessity of providing access along the edges of the slab limits the use and prohibits the placement of slabs in a side-by-side abutting arrangement. In addition, these structures lack the substantial structural advantages present with longitudinally extending prestressing elements.

To avoid the disadvantages of prestressing from the sides of a slab transverse to its length, attempts have been made to run the prestressing elements longitudinally along the length of the slab. Examples of these attempts can be found in the U.S. Pat. Nos. 3,022,713; 3,089,215; 3,237,537; and 4,245,923.

In some of these prior art systems, concrete highway is poured in lengths of a few hundred feet with the prestressing elements therein extending longitudinally of the slab. A gap is left at the end of the slab and the ends of the prestressing elements extent into the gap. For example, in the patent to Stubbs, U.S. Pat. No. 3,089,215, slabs of concrete in a length of approximately 200 feet are poured with gaps in between the slabs. These gaps are of a sufficient size to allow the operation of post-tensioning jacks. Once the concrete is set and the post-tensioning has been completed, concrete is poured into these gaps to the final level of the elongated slabs. The patent to Stubbs acknowledges that these closure strips do not have the strength or flexibility of the adjacent prestressed slabs. Constructing post-tension slabs by providing gaps between the slabs also presents disadvantages in that the pavement cannot be used during the curing of the slab.

DISCLOSURE OF THE INVENTION

According to this invention, an improved method and apparatus of forming an elongated prestressed slab is disclosed. According to the invention, a slab is poured utilizing conventional equipment with post-tensioning tendons being placed in the slab to extend longitudinally along the slab. At intervals of, for example, approximately 300 feet, the present invention contemplates the placement of a temporary removable steel bulkhead extending transversely across the slab and the formation of small access slots behind the bulkhead along each of the tendons. The post-tensioning tendon extends longitudinally through the slots. These slots are designed of a sufficient size and shape to allow jacking equipment to engage in post-tension tendons. Temporary covers are provided for the slots such that the pavement can be used even during an extended post-tensioning process.

Anchor heads are provided in each of the slots to anchor the tendons in tension. The post-tensioning tendon is spliced where required by the length of the cable in the slots so that the cable extends continuously along the length of the slab.

The method of post-tensioning the lateral reinforcing is accomplished in two steps. The first post-tensioning step can occur within 24 hours of pouring the slab. Following that initial post-tensioning, the slots are covered with removable covers such as steel plates and the slab is ready for use during curing. When initial curing is complete, for example, at the end of 30 days, the final post-tensioning step is completed and the temporary bulk-heads are removed and the grooves left by removal of the temporary bulkheads and slots provided for spaced access to the tensioning cables are filled with epoxy, cement or other suitable materials.

Each of the two post-tensioning steps is accomplished by using two jacks or tensioning means in a progressive manner along the length of tendon to be tensioned. For example, a complete day's length of slab is initially post-tensioned as follows. A jack is placed in the first set of slots formed during the day's pouring, i.e., at the end of the first 300 foot length of slab. A second set of jacks is placed at the end of the day's pouring, for example, at the end of the 1200 or 1600 feet of slab poured that day. The cables are then post-tensioned progressively with the first set of jacks operated to achieve the initial post-tensioning amount in the cables in the first 300 feet of tendon. Thereafter, the second set of jacks are operated to post-tension the remainder of length of the day's poured slab. The first set of jacks are then removed with the anchors holding the tendons in place in the first section and moved to the second set of slots wherein the process of operating the first set of jacks is repeated to tension the next length of slab. The second set of jacks are again operated to achieve required post-tensioning through the entire length of the slab. This process is repeated along the slab at each successive temporary bulkhead until the entire day's pouring has been completed. This process is repeated at the final post-tensioning, for example, at approximately 30 days after the slab has been poured.

Thus, according to the present invention, a continuously prestressed slab can be formed with longitudinally extending tendons that are continuous along the length of the slab. The slab contains no intermediate weakened gaps and does not require the provision of side clearance for post-tensioning.

BRIEF DESCRIPTION OF THE DRAWINGS

This invention will be described by reference to the following drawings.

DETAILED DESCRIPTION

Figure 1:
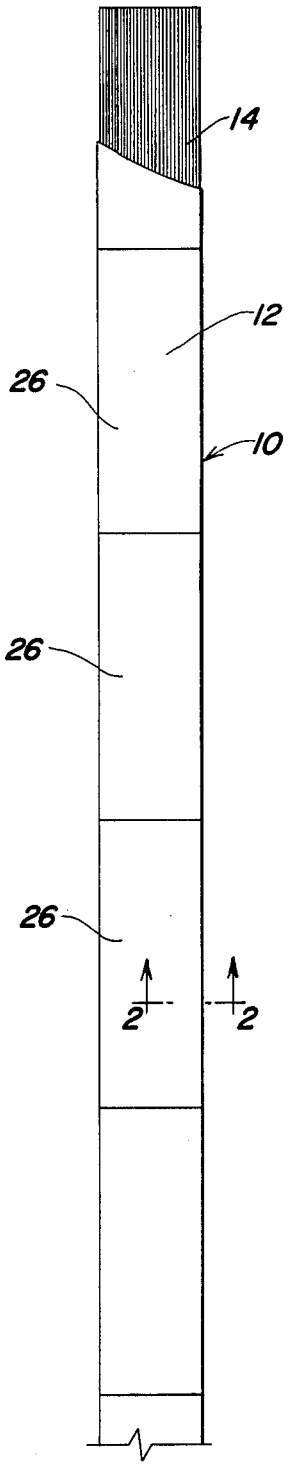
FIG. 1 is a plan view of a section of highway with a plurality of the longitudinally extending post-tension tendons exposed to view.
Figure 2:
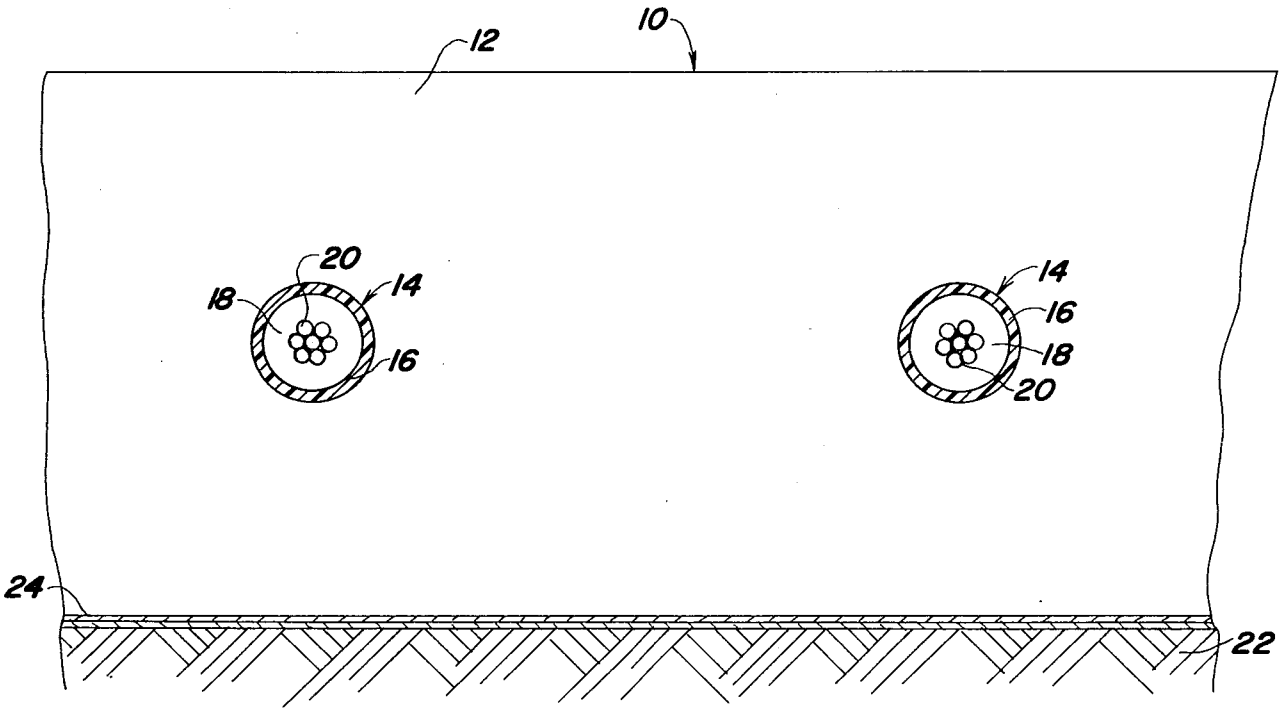
FIG. 2 is a sectional view taken along line 2—2 of FIG. 1 looking in the direction of the arrows.

Referring now to the figures, wherein like reference characters designate like or corresponding parts throughout the several views, there is illustrated in FIGS. 1 and 2 a highway 10 constructed according to the present invention. A cross section of the highway 10 is shown in FIG. 2 as consisting of concrete 12 and post-tensioning tendon assemblies 14 extending longitudinally along the length of the highway 10. These tendon assemblies comprise a cover 16 of paper, plastic or the like, which encloses a lubricant 18 and a steel tendon or cable 20. The highway 10 is built upon a sub-base 22 prepared in a conventional manner with a pair of polyethylene sheets 24 separating the concrete portion 12 to reduce subgrade drag. The highway 10 is formed in a plurality of discrete segments 26.

In forming the highway 10, a conventional slip form paving apparatus can be used, preceded by a mobile self-powered frame (not shown) containing coils of tendon assemblies 14 in substantial lengths, for example, 6,000 to 7,000 foot coils. This unit containing the coils of tendon assemblies 14 would precede the slip form paver so as not to interfere with concrete delivery. As will be described in more detail, pavement is poured continuously. However, at intervals which, for example, could be selected at 300 feet, a temporary bulkhead is coated with a release agent and inserted into the slab to define the boundary between the segments 26. Small forms are placed in the wet pavement adjacent to the bulkheads to form gaps as will be described hereinafter to allow for tensioning of the longitudinally extending tendons at the boundary of the segments 26. For example, selecting the segments to be 300 feet in length, where the steel tendon or cable is selected to be from 0.5 to 0.6 inches ASTMA416 steel strand surrounded by grease and jacketed in either extruded polyethylene or paper, prestressing can be achieved at approximately 450 psi.

Figure 4:
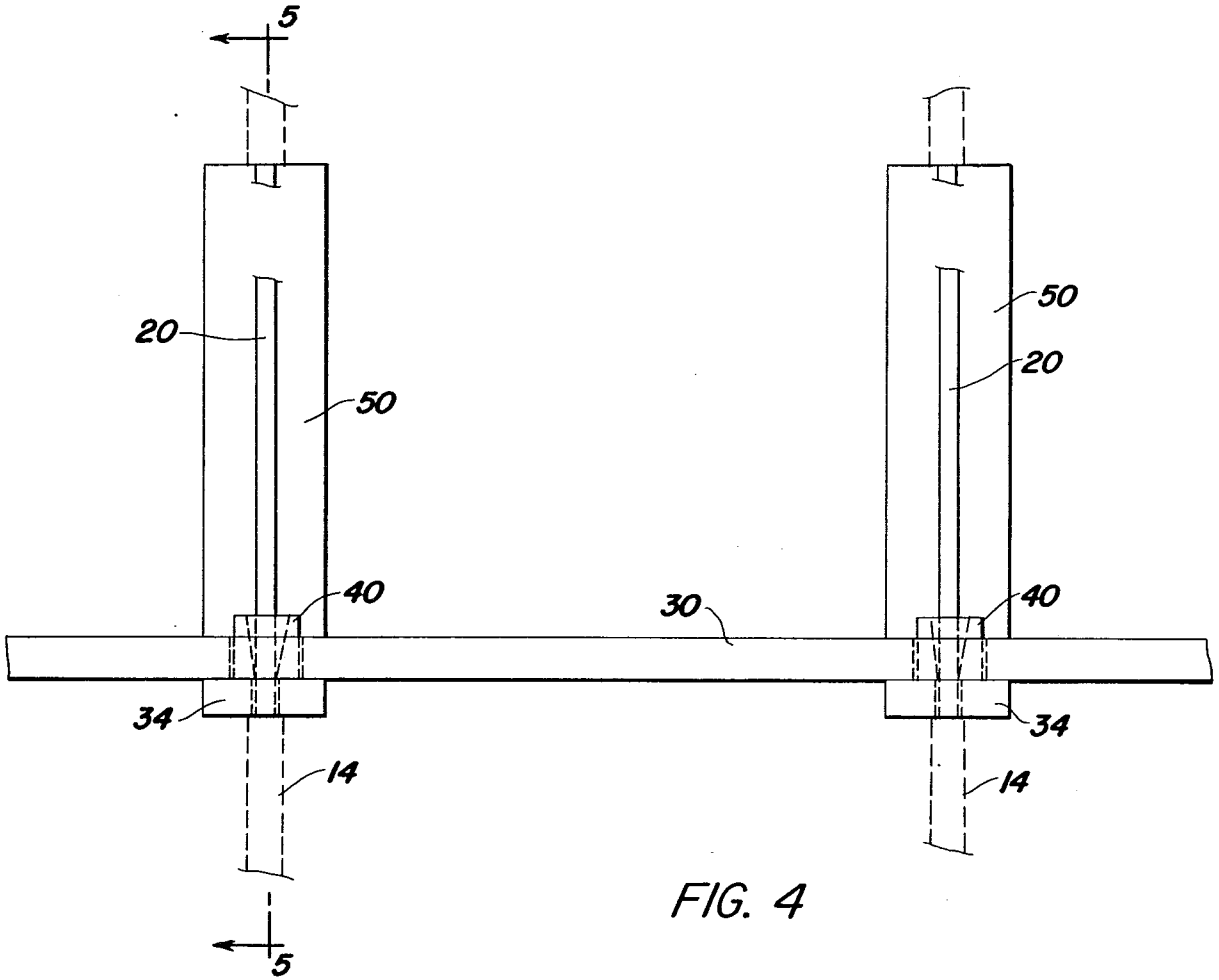
FIG. 4 is an enlarged plan view showing a temporary bulkheat, slot, longitudinal prestressing tendon and anchor therefor.
Figure 6:
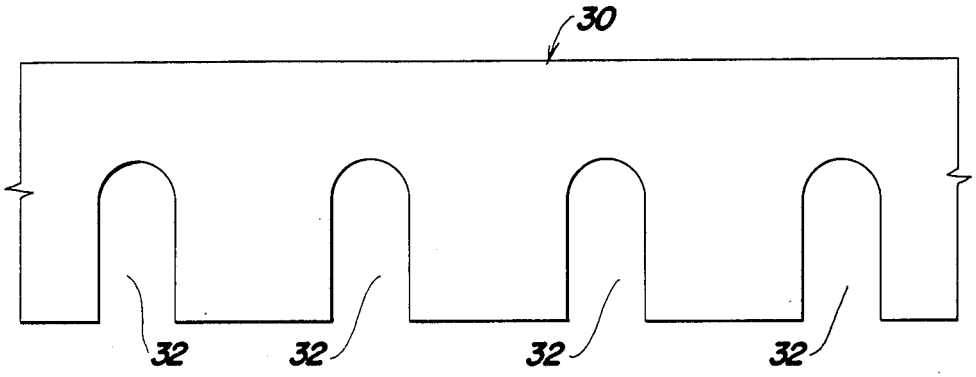
FIG. 6 is an elevation view of the temporary bulkheads.
Figure 7:
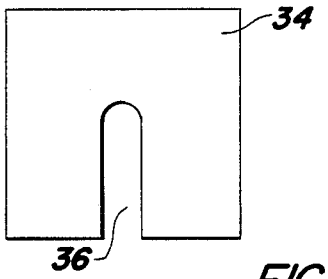
FIG. 7 is an elevation view of the bearing plate.

The temporary bulkhead 30 utilized between the segments 26 is shown in detail in FIG. 6. The bulkhead 30 has a plurality of downwardly extending slots 32 which are spaced across the width of the bulkhead 30 at a spacing equal to the spacing of the tendon assemblies 14. During formation of the slab of highway 10, these temporary bulkheads 30 are placed transversely across the slab as shown in FIG. 1 at the end of the segments 26. Prior to inserting the temporary bulkheads 30, a bearing plate 34 is positioned on the bulkhead as shown in FIG. 4. These bearing plates are shown in detail in FIG. 7 as comprising a quadrilateral shaped steel plate with a slot 36 therein. These bearing plates 34 are lightly tack welded onto the temporary bulkhead 30 as shown in FIG. 4 with the center line of slot 36 aligned with the center line of slot 32. A bearing plate 34 is provided for each of the slots 32 and the slot 36 of the bearing plate 34 fits over the tendon assembly 14 as shown in FIG. 4.

Figure 8:
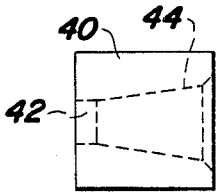
FIGS. 8 and 9 are views of an anchor utilized to anchor the tendons of the present invention.
Figure 9:
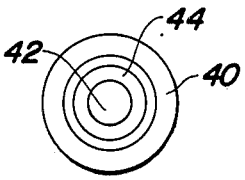

An anchoring means such as a doughnut anchor member 40 can be placed around the tendon assembly 14 to abut against the bearing plate 34 as shown in FIG. 4. The details of the construction of this anchor 40 are shown in FIGS. 8 and 9. The anchor 40 has a bore 42 which is countersunk at 44 to provide a frustoconical-shaped surface. This surface cooperates with semi-cylindrical tapered shims to anchor the tendon 20 in a conventional manner. A sufficient number of anchors can be placed around the tendons at the beginning of the operation. Alternatively, the anchor can be slit, or be slotted, or be formed in two pieces to allow the anchor to be placed around the tendon during pouring. It is to be appreciated that other tendon anchoring means may be utilized.

Figure 5:
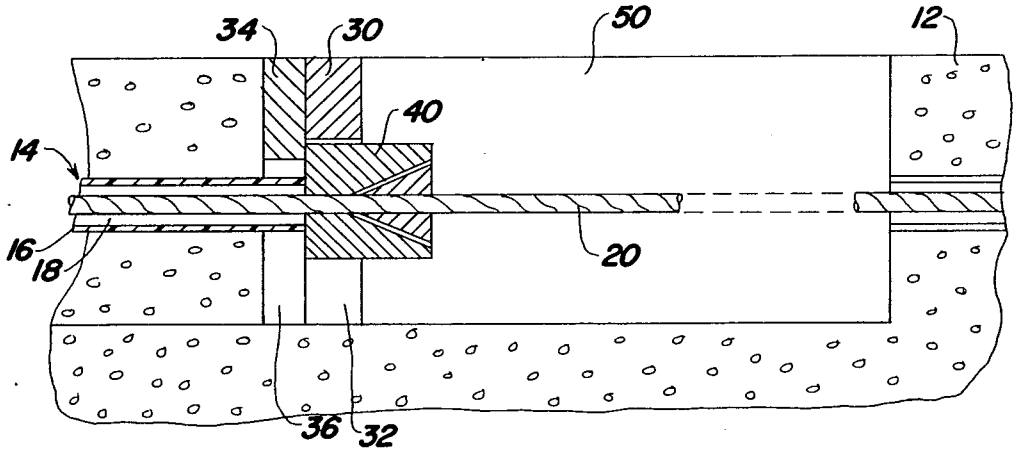
FIG. 5 is a sectional view taken along line 5—5 of FIG. 4 looking in the direction of the arrows.

As can be seen in FIGS. 4 and 5, a rectangular cross section slot is formed around each of the tendon assemblies 14 adjacent to the temporary bulkhead 30. This slot 50 is selected to be of sufficient size and shape to allow for a jacking apparatus (not shown) to engage the steel tendon 20 and post-tension it in the tendon. These slots 50 can be formed in the concrete by removable forms.

Figure 10:
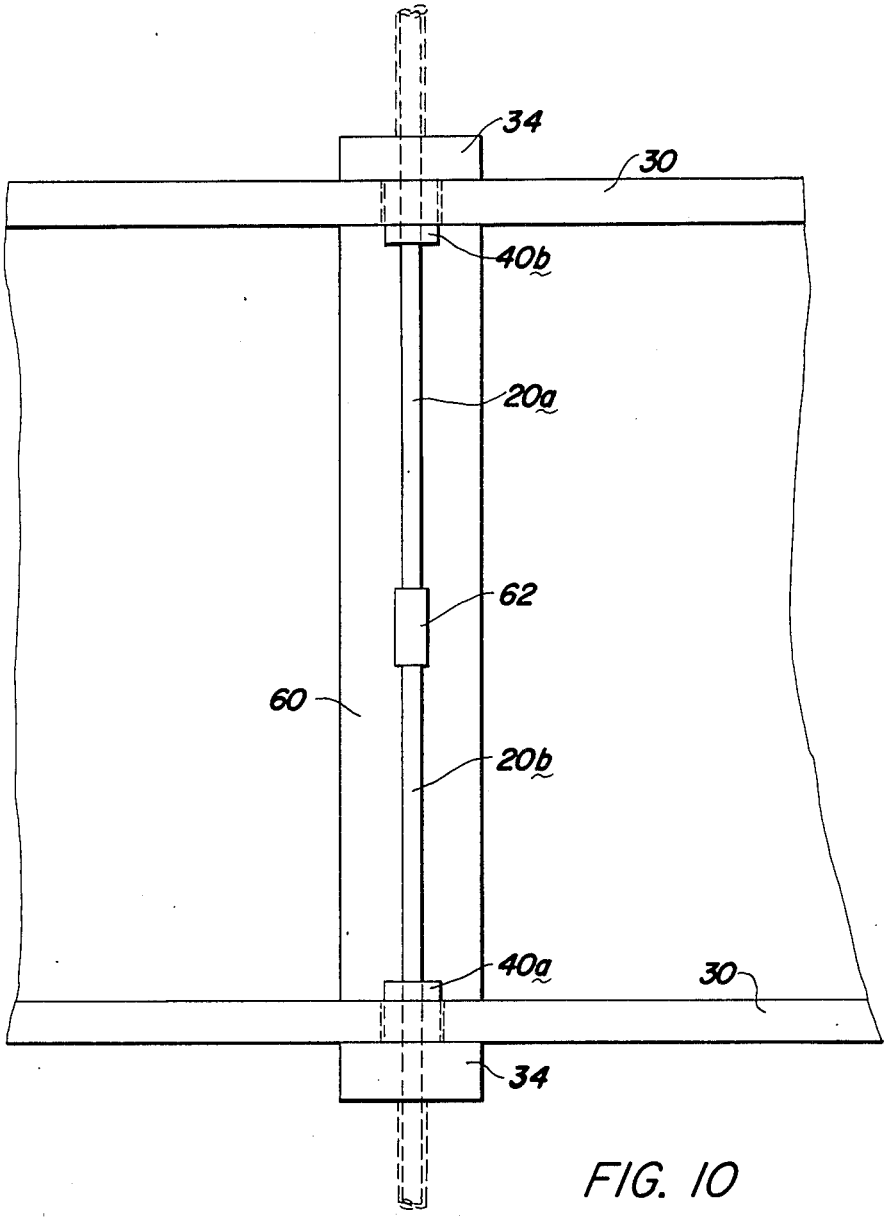
FIG. 10 is a plan view of temporary bulkheads and a gap in which the longitudinally extending tensioning cable is spliced.

In FIG. 10, a second slot construction is shown and identified as reference numeral 60. This construction can be used at the end of each day's pour or at other convenient intervals. The slot 60 is likewise a sufficient length to allow a tensioning apparatus to engage the post-tensioning tendon. The slot 60, however, can have a bulkhead 30 at either end thereof and bearing plate 34 facing in opposite directions with the doughnut anchors 40*a* and 40*b* resting against each bearing plate 34. In this manner the slot 60 and opposite facing anchors 40 can be utilized to splice the end of one tendon 20*b* to a new tendon 20*a* or to remove slack from the tendon in subsequent tensioning operations. The anchors 40 protect the splice during its installation. During final post-tensioning, anchor 40*b* can be disengaged to allow tensioning of the cable continuously along the length of the slot 60.

Figure 3:
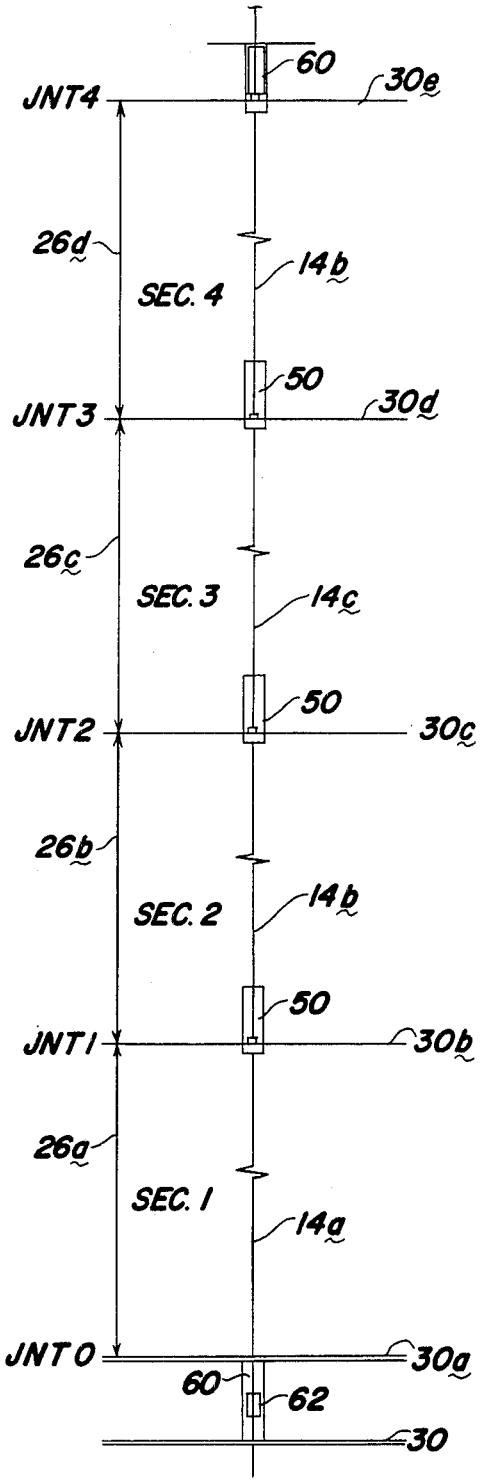
FIG. 3 is a schematic view of a section of highway showing placement of the spaced bulkheads and gaps for post-tensioning a tendon.

The method of laying a highway and post-tensioning same according to the present invention will be described by reference to FIG. 3. In FIG. 3 one continuous tendon is shown. It is to be appreciated that numerous parallel longitudinally extending tendons will be present in each highway slab and that the process of the present invention would be simultaneously performed on each of the tendons in the slab. At the beginning of the day of pouring concrete or where required, a splice 62 can be formed in a slot 60 by use of a form and a bulkhead 30*a* is inserted at the beginning of the day's pour. The concrete slab is then poured along a first highway segment 26*a* for distance, for example, of 300 feet. At that point, a bulkhead 30*b* is inserted into the slab. During the entire pouring process a continuous length of a tendon assembly 14 is unrolled in front of the pouring operation along the length of the slab. The tendon length 14*a* is located in highway segment 26*a;* likewise, a length of tendon 14*b* is located in segment 26*b,* with similar designations being used for segments 26*c* and 26*d*. After bulkhead 30*b* is in place, the pouring process continues and sections 26*b,* 26*c* and 26*d* are poured consecutively during the day's pouring operation. At the end of the day, bulkhead 30*e* is installed and the pouring process is discontinued, for example, after 1200 feet have been poured. It is to be appreciated that at each of the bulkheads 30*a,* 30*b,* 30*c,* 30*d* and 30*e* slots 50 are formed in the concrete around each of the tendons and each of the bulkheads. The concrete is then allowed to cure, after which the initial step of post-tensioning begins.

Post-tensioning is accomplished by using two sets of jacks on each of the tendons. Initially, one of the jacks is placed at the end of the first section 14*a* in the slot adjacent to bulkhead 30*b* to tension the cable assembly 14*a*. Simultaneously, a second jack is placed in the slot 50 formed behind bulkhead 30*e* to tension the entire length of tendon assemblies 14 for the entire day's pour. The jack adjacent to the bulkhead 30*b* is operated to tension the cable 14*a* to the desired initial post-tensioning level with the anchor 40 holding the tension in the cable. The jack at bulkhead 30*e* is likewise operated to tension the entire length of cable between bulkhead 30*b* and 30*e*. The jack at bulkhead 30*b* is then moved to bulkhead 30*c* where the length of tendon 14*b* between bulkheads 30*b* and 30*c* is tensioned to a desired level. It is to be appreciated that since the anchors at bulkhead 30*b* operate in only one direction, the tensioning tendon at bulkhead 30*c* will result in a uniform tension along the length of each tendon between bulkheads 30*a* and 30*c*. At this point the anchor at bulkhead 30*b* can even be disengaged until the final tensioning operation, to insure that the tension in tendon 14*a* and 14*b* is uniform along its length. The second jack at bulkhead 30*e* is then operated to tension the length between bulkhead 30*c* and 30*e*.

This progressive process is repeated at bulkhead 30*d* until the entire length of tendon has been progressively tensioned in this manner to an amount that is uniform along its length and the intermediate anchors are removed from the tendon. It is to be appreciated that this process is accomplished by placing jacks on all of the tendons so the process can be performed simultaneously on all the tendons insuring uniformity of tension in all tendons.

After this initial post-tensioning, either a temporary grout can be placed in the slots 50 and 60 or a steel cover can be placed over the slots to allow later access. These slot covers can be plates of the same size as the slots with legs extending down into the slot to hold the plate at a level flush with the concrete surface. In this manner, the highway can be used once the initial step of post-tensioning has occurred.

The second step of post-tensioning occurs after the concrete has set for approximately 30 days, depending upon weather and temperature conditions. In the second or final stressing, the process is again repeated. During this second post-tensioning, slack can be removed from the tendons at slots 60, without detensioning the remainder of the tendon. Subsequent to the second or final stressing, the bulkheads can be removed and joint compound placed in the groove formed by the removal of the bulkhead. The grooves 50 and 60 can be filled with epoxy, cement or suitable filler to permanently close theses grooves.

EXAMPLE

To make a 24 ft. wide prestressed post-tensioned slab as disclosed herein, 48 longitudinally extending E5-1 monostrand tendons are placed in a conventional form of the type utilized with slipform concrete paving machines. The tendons comprise about 0.5 inch diameter ASTM 416 steel strand surrounded by grease and jacketed in extruded polyethylene or another similarly effective jacketing material. Temporary steel bulkheads are placed at intervals of approximately 300 ft. and equipped with slotted bearing plates and plastic blockout formers. The blockout formers are adapted to be slipped over the strand and locked into the bearing plate as previously described in the specification. The tendons are mounted on a mobile selfpowered frame in coils each containing at least a sufficient length of tendon to cover the distance to be paved that day. This avoids the need for splicing the strand during a single day's operation. The bulkhead is preferably coated with a form release agent, and prefabricated bursting reinforcing steel is installed at either side of the joint. The mobile frame precedes the slipform paver so as not to interfere with concrete delivery. Two sheets of polyethylene are placed beneath the slab to reduce subgrade drag during tensioning. Slipform paving proceeds at its normal rate and width. At the end of each day's paving, the strand is cut.

After each day's pour, when the concrete strength is about 1200 psi, each strand is simultaneously stressed with two jacks. One jack is placed at the intermediate anchorage after coupling each tendon to the corresponding tendon in the slab stressed the previous day. The other jack is located at the joint where the slab to be stressed terminates. Each tendon is stressed to approximately 0.4 $f'_s$. Due to shortening of the concrete during this initial stressing, a void of approximately 3 to 6 inches is created at the end of the pour. This void is preferably concreted the same evening so that stressing may proceed in the next section on the following day.

About one month after pouring, the slab is stressed again. The second stressing is desirably done when the maximum concrete temperature is approximately 50° F. or at a temperature consistent with expected minimum service temperatures (minimum service temperature plus about 40° F.). During this stressing, a reversed doughnut desirably anchors the opposite end of the blockout. The reverse doughnut allows the portion of the pour ahead of the slab being stressed to be detensioned at completion of stressing. Stressing is done by uncoupling the strand to be stressed and then proceeding to the blockouts approximately 300 feet from the end joint of the last section stressed. During the second stressing, the tendons are desirably stressed to about 0.8 $f'_s$. This stressing causes the concrete to shorten by another $\frac{1}{4}$ to $\frac{3}{4}$ inches. The steel bulkhead is then removed and the void is filled with epoxy or other suitable quick-setting joint fillers. When about half of a single day's pour is restressed, a second ram is mounted at the day-ending bulkhead joint and the remaining tendons are stressed simultaneously from both locations. Once the stressing operation is completed up to the day-end joint, the tendons are desirably recoupled.

Thus, it can be appreciated that by practicing the method and apparatus of the present invention, a post-tensioned slab with longitudinally extending continuous tendons can be formed in an efficient and inexpensive manner. It is also to be appreciated that the tension in a single tendon will be uniform along its length. It is also to be appreciated that other methods and apparatus of practicing the same invention can be utilized to achieve the same purpose without departing from the spirit and scope of the appended claims defining the invention.

What is claimed is:

1. A highway construction comprising a sub-base, an elongated concrete slab having a plurality of segments resting on the sub-base, a plurality of continuous tendons extending longitudinally of the slab positioned in said concrete and spaced across the width thereof, a plurality of slots at predetermined locations within said slab adjacent the ends of said segments and extending longitudinally of the slab formed across the width of said slab to expose said tendons at spaced longitudinal locations between opposite ends of the slab, positioning at said slots means for anchoring and engaging said tendons to tension said tendons at said slots, whereby compressive portions are formed in said segments including portions between said slots.

2. The highway construction of claim 1 wherein said tendons are parallel extending.

3. The highway construction of claim 1 wherein said tendons comprise multiple strand cable and wherein said tendons are encased in a protective covering to allow said tendons to slide through said covering.

4. The highway construction of claim 1 wherein said tendons are stressed in tension.

5. The highway construction of claim 4 wherein anchor means are positioned in at least one of said slots for engaging said tendon and for selectively anchoring said tendon against longitudinal movement in at least one direction.

6. The highway construction of claim 5 additionally comprising bearing plate means positioned in at least one of said slots engaging said anchor means for transferring the tension of said tendon to said slab.

7. A method of forming a prestressed post-tensioned slab having a plurality of segments each including continuous longitudinal tendons comprising the steps of: positioning a plurality of continuous longitudinally extending tendons in a form; pouring concrete over said tendons to form a slab segment; selectively forming longitudinally extending slots at spaced locations in said concrete around each of the tendons at spaced locations adjacent opposite ends of said segments to allow access to said tendons at said spaced locations, said slots being positioned to form compression elements spanning between adjacent slots; positioning at said slots anchoring means for anchoring said tendons; and tensioning said tendons by engaging said tendons at a first end of said slots after said concrete has been poured to increase compressive loading in said compression elements between slots.

8. A method of forming a prestressed post-tensioned slab having a plurality of segments each including continuous longitudinal tendons comprising the steps of: placing a plurality of longitudinally extending transversely spaced continuous tendons in a form; pouring concrete over said tendons and selectively forming at spaced locations intermediate the ends of the slab at least one longitudinal extending slot in said concrete around each of the tendons to allow access to an intermediate portion of said tendons at a location between the ends of the slab, forming said slot to be narrower in transverse width than the transverse width of the slab; positioning at said slots means for anchoring and engaging said tendons to tension said tendons, and pouring concrete in the spaces between said slots to form a plurality of slab segments each with at least a portion thereof continuous from end to end whereby compressive portions of said slab are formed in said segments including the transverse portions between said slots, allowing said concrete to at least partially set and thereafter tensioning said tendons by engaging said tendons at said slots.

9. The method of claim 8 wherein the step of tensioning said tendons comprising the steps of: positioning jack means in the slots to engage said tendons at said slots after said concrete has been poured; and actuating the jack means to increase tension in a portion of a tendon extending through at least two slots spaced longitudinally of the slab.

10. The method of claim 9 additionally comprising the step of tensioning said tendons an additional time after the concrete has cured.

11. The method of claim 11 additionally comprising the step of filling the slots once tensioning of said tendon is completed.

12. The method of claim 9 wherein said step of tensioning said tendons comprises initially tensioning a first length of tendon extending between two adjacent slots and thereafter tensioning said first length of tendon after said concrete has set a substantial amount.

13. A bulkhead apparatus for use in forming a continuous post-tensioned slab highway using parallel spaced longitudinally extending tendons comprising a body of sufficient width to extend across the width of the slab, said bulkhead having a plurality of spaced openings therein corresponding to spacing of the tendons in the slab; and a plurality of bearing plates releasably connected to said bulkhead at each of said openings, whereby said openings position said tendons.

14. The bulkhead assembly of claim 13 additionally comprising anchoring means engaging said bearing plates for selectively anchoring said tendons against longitudinal movement in at least one direction.

* * * * *

UNITED STATES PATENT AND TRADEMARK OFFICE

CERTIFICATE OF CORRECTION

PATENT NO. : 4,621,943

DATED : November 11, 1986

INVENTOR(S) : David T. Swanson

It is certified that error appears in the above-identified patent and that said Letters Patent is hereby corrected as shown below:

In Column 2, line 15, change "extent" to -- extend --; and in Column 8, line 23, change "longitudinal" to -- longitudinally --.

Signed and Sealed this

Twenty-fourth Day of February, 1987

*Attest:*

DONALD J. QUIGG

*Attesting Officer* *Commissioner of Patents and Trademarks*